United States Patent [19]

Zike

[11] Patent Number: 4,947,625

[45] Date of Patent: Aug. 14, 1990

[54] BAG-FORMING AND FILLING APPARATUS AND PROCESS

[76] Inventor: Donald R. Zike, 4106 Laura La., Yakima, Wash. 98908

[21] Appl. No.: 270,932

[22] Filed: Nov. 14, 1988

[51] Int. Cl.[5] ..... B65B 9/14

[52] U.S. Cl. ..... 53/459; 53/567

[58] Field of Search ..... 53/567, 564, 558, 459, 53/456, 452

[56] References Cited

U.S. PATENT DOCUMENTS

| | | | |
|---|---|---|---|
| 2,490,940 | 12/1949 | Barker | 53/459 X |
| 3,360,901 | 1/1968 | Gallo | 53/567 |
| 3,812,642 | 5/1974 | Mintz et al. | 53/459 X |
| 3,908,335 | 9/1975 | Giannelli | 53/567 X |
| 3,931,701 | 1/1976 | Bowman et al. | 53/567 X |

*Primary Examiner*—James F. Coan

*Attorney, Agent, or Firm*—Robert W. Beach; Ward Brown

[57] ABSTRACT

The leading end of tubular bag-making material is clamped between presser rods externally of the tubular material and a distender within the tubular material, and the clamping rods are moved upward to draw a bag-making length of material. The upper end of such length of material is spread by resilient wires to receive clamping means between them. The gripping rods are then withdrawn from the distender which falls freely through the bag-making material while the gripping rods are moved downward preparatory to gripping the next length of bag-making material and the bottom of the first length of material is closed and severed to complete a bag.

14 Claims, 12 Drawing Sheets

BAG-FORMING AND FILLING APPARATUS AND PROCESS

BACKGROUND OF THE INVENTION

1. Field of the Invention

This invention relates to apparatus and a process for forming and filling bags from continuous tubular bag-making material.

2. Prior Art

In the past, bags have been made from continuous tubular bag-making material such as a plastic film or mesh by cutting a piece of such material to a desired length, closing one end of such cut length of material, opening the other end of such cut length of material and supporting such cut length of material to receive product such as produce, for example, onions, potatoes, oranges, apples, garlic and nuts. In some instances the bag-making material has been gathered onto a rigid sheet metal or plastic pipe, the end of the bag-making material tube beyond the end of the pipe has been closed to form a bag bottom and the product to be bagged has been supplied through the rigid pipe into the bag. As the product accumulates in the portion of the bag beyond the rigid pipe, bag-making tubular material gathered on the pipe is pulled off the pipe to form a bag of desired length. The tubular bag-making material is then cut appropriately to leave enough slack for closing the upper end of the bag and the portion of the bag at the side of the cut opposite the filled bag is closed to form the bottom of the next bag to be filled.

Such bag-making and filling procedures require considerable manual labor and are slow.

SUMMARY OF THE INVENTION

A principal object of this invention is to provide an apparatus and method for making and filling bags automatically from continuous tubular material of plastic film or mesh.

A more specific object is to provide such apparatus which will draw a bag-making length of tubular bag-making material upward from a supply, support such material by its upper end, cut and close such material at a selected location below its upper end to form a bag bottom and fill such bag, all without the requirement of manual labor.

The foregoing objects can be achieved by supplying continuous bag-making tubular material to drawing intermittent feeder means to draw upward a length of bag-making material sufficient to form a bag, severing the bottom of such length of bag-making material from the rest of the bag-making material supply, closing the bottom of the severed bag-making material length to form a bag, opening the top of such bag and depositing product in it, and automatically repeating such process.

DETAILED DESCRIPTION

Figure 1:
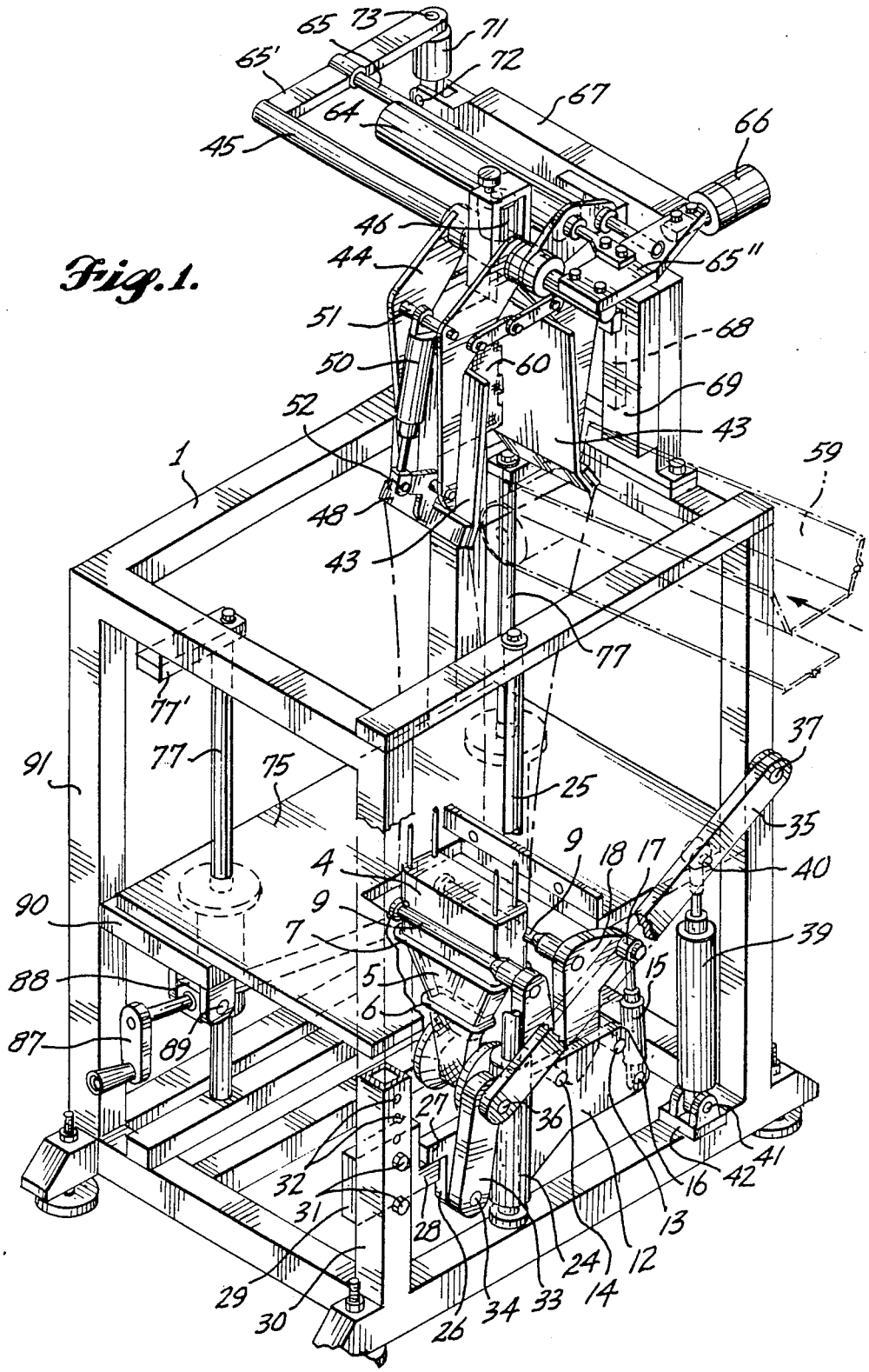
FIG. 1 is a top perspective of bag-making apparatus with parts broken away and other parts omitted for clarity of illustration.
Figure 2:
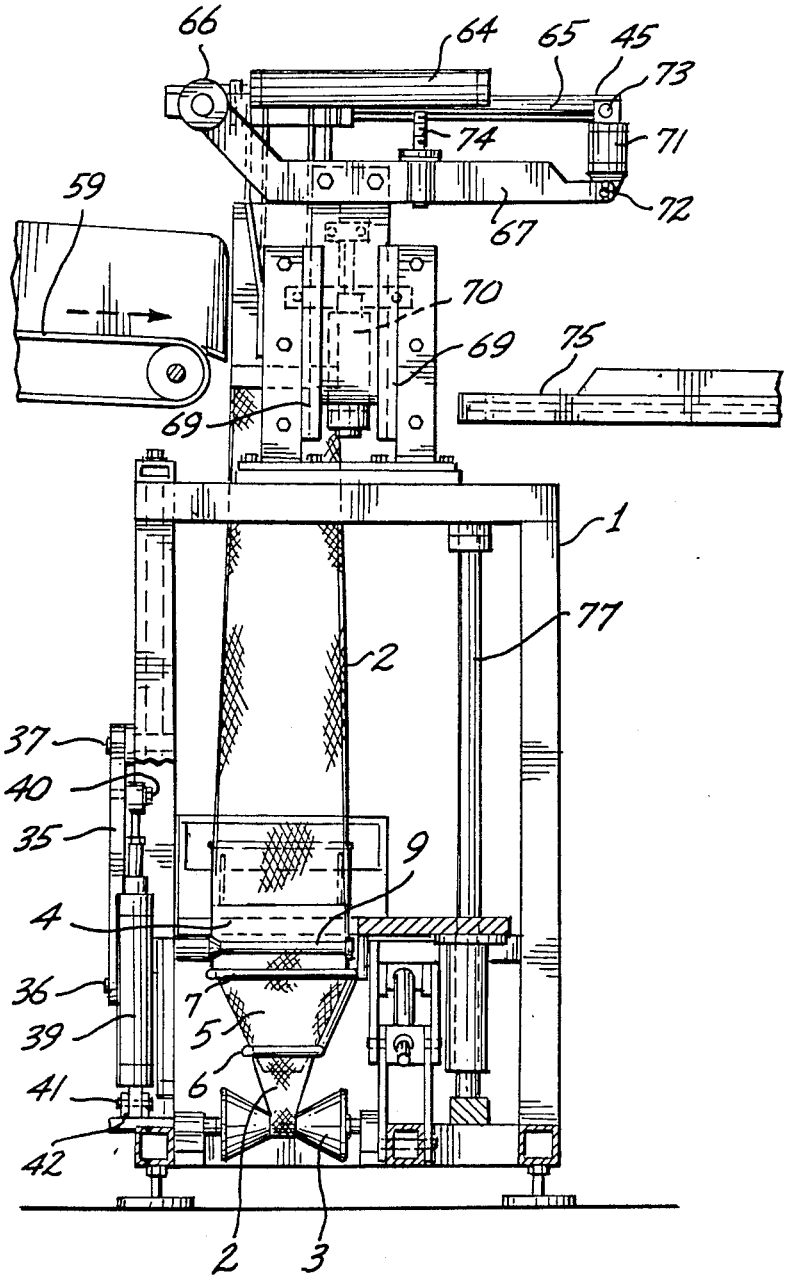
FIG. 2 is an end elevation and FIG. 3 is a side elevation of such bag-making apparatus.

The apparatus of the present invention performs automatically the process of feeding from a continuous length of tubular bag-making material a length of such material appropriate to form a bag of the desired length, forming such length of material into a bag, filling such formed bag with product and freeing the filled bag from the apparatus. The bag-forming apparatus shown generally in FIGS. 1 to 6, inclusive, forms the bag in upright position for subsequent filling in the same position.

The apparatus is composed of a frame 1 carrying supply means for continuous bag-making material 2 such as of plastic film or mesh, for example with apertures having a width of about ¼ inch. Such material can be used for making bags of various sizes, an example being 2 or 3 feet long and 1 or 2 feet in diameter when filled. Such tubular bag-making material may be supplied on a reel (not shown) and guided to the apparatus by a double conical pulley 3 from the supply source. The bag-making material passes upwardly around a distender in the form of a shuttle having an upper portion 4 preferably of rectangular horizontal cross section carrying resilient cantilever wires 53 projecting upward from its corners and a lower portion 5 tapering downward from such upper portion. Such distender is cradled in its lower position shown in FIGS. 1, 2 and 3 in a lower stop ring 6 engageable with the lower part of the tapered portion 5 of the shuttle and an upper stop ring 7 engageable with the tapered portion 5 of the shuttle at a location spaced upward from the lower stop ring 6 or engageable with the lower part of the upper portion 4 of the shuttle.

The distender or shuttle constitutes one component of intermittent feeding means operable to draw upward from the guide roller 3 a length of bag-making material appropriate to make a bag.

To effect such a bag material drawing operation, such material is gripped by gripping means. The upper portion 4 of the distender has parallel, horizontal, substantially semi-cylindrical grooves 8 in its opposite sides directly opposite each other as shown, for example, in FIGS. 5 and 13, into which presser members in the form of gripping rods 9 can be pressed. The distender 4, 5 is located within the tubular bag-making material and the presser rods 9 are outside such material so that when the rods are moved into the pressing position lodged in the grooves 8, as shown in FIGS. 3, 4, 10 and 11, the upper end of the bag material will be gripped between the gripping rods and the distender.

Figure 15:
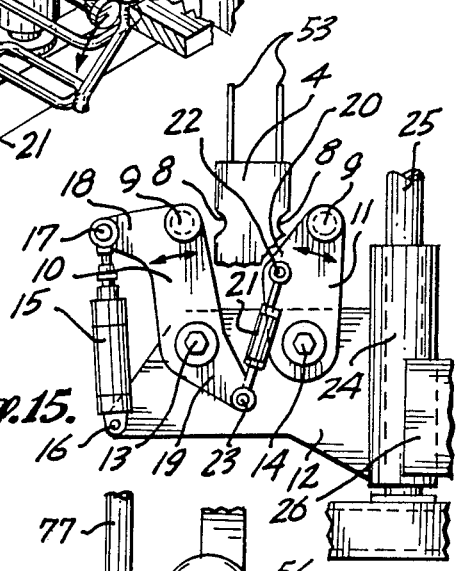
FIG. 15 is a detail elevation of a portion of the apparatus.

The mechanism for moving the gripping rods 9 into and out of the distender grooves 8 is shown best in the fragmentary detail view FIG. 15. Corresponding ends of the gripping rods 9 are mounted in arms 10 and 11, respectively, from which the rods are supported in cantilever fashion. Such arms are mounted on a plate 12 by pivots 13 and 14, respectively, spaced apart transversely of the lengths of the gripping rods 9.

Arm 10 is swung about its pivot 13 to move its rod 9 into pressing engagement with the groove 8 in the distender 4, 5 and for retraction from such groove by a actuator such as a fluid pressure jack 15 which may be pneumatic. Such jack is mounted on plate 12 by pivot 16 and its opposite end is connected by a pivot 17 to a horn 18 projecting laterally from the arm 10. The arm 11 is swung conjointly with the arm 10 to move its rod 9 simultaneously into or to retract it from the other groove 8. Arm 10 has a depending toe 19 and arm 11 has a lateral projection 20 between its pivot 14 and its rod 9. An adjustable length link 21 has one end connected by a pivot 22 to the lateral projection 20 and its other end connected by a pivot 23 to the toe 19 of the arm 10.

When the jack 15 is contracted, as shown in FIG. 15, arm 10 is swung counterclockwise to withdraw its rod 9 from its groove 8. The swinging of toe 19 pushes on link 21 through its pivot 23 which link, in turn, pushes on arm 11 through pivot 22 to swing such arm clockwise about its pivot 14 for retracting its gripping rod 9 from its groove 8. Extension of jack 15 will swing its arm 10 clockwise to insert its gripping rod 9 into its groove 8 of the distender 4, 5 to grip bag-making material between such rod and groove. Swinging of toe 19 thus effected will pull link 21 to swing arm 11 in a counterclockwise direction about its pivot 14 for pressing its rod 9 into its groove 8 of the distender 4, 5 to clamp bag-making material between such rod and groove.

Figure 3:
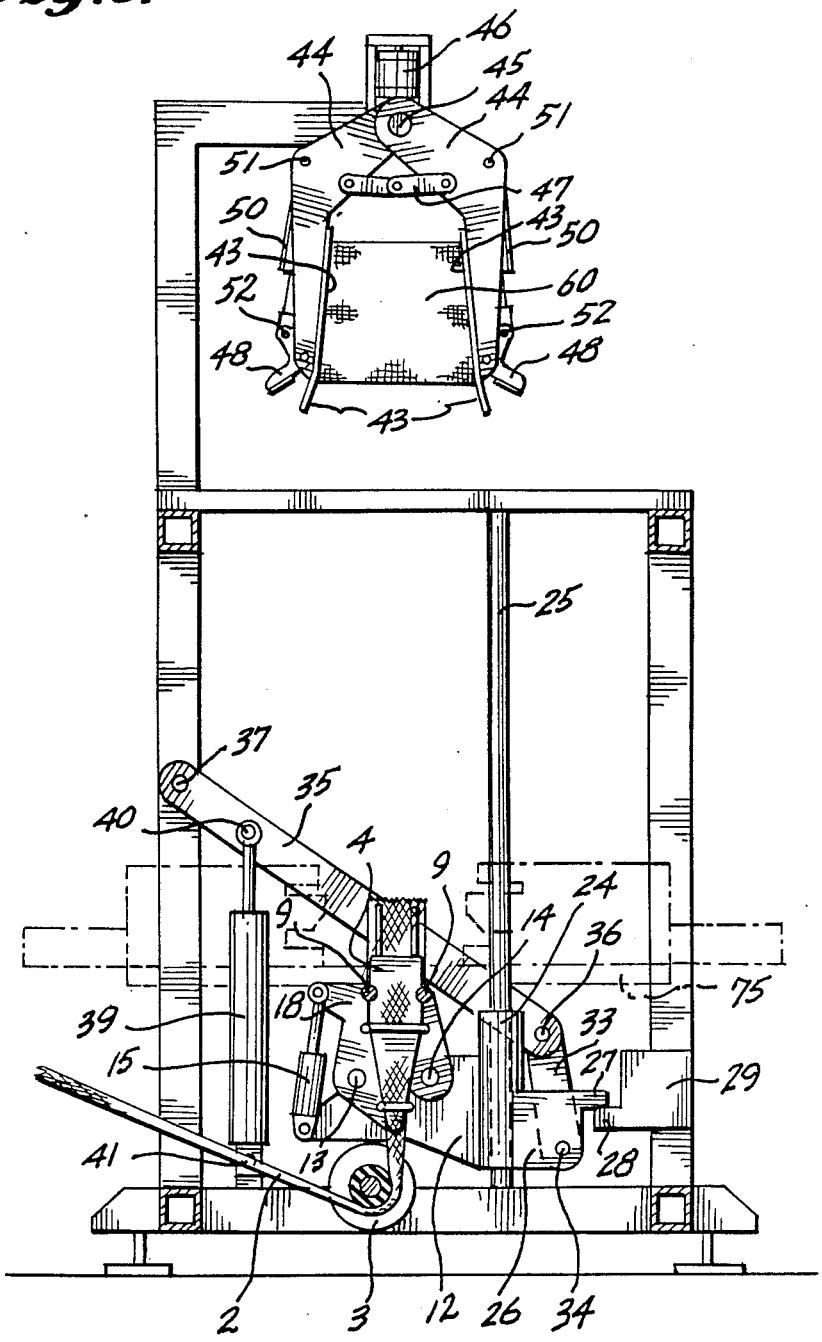
Figure 4:
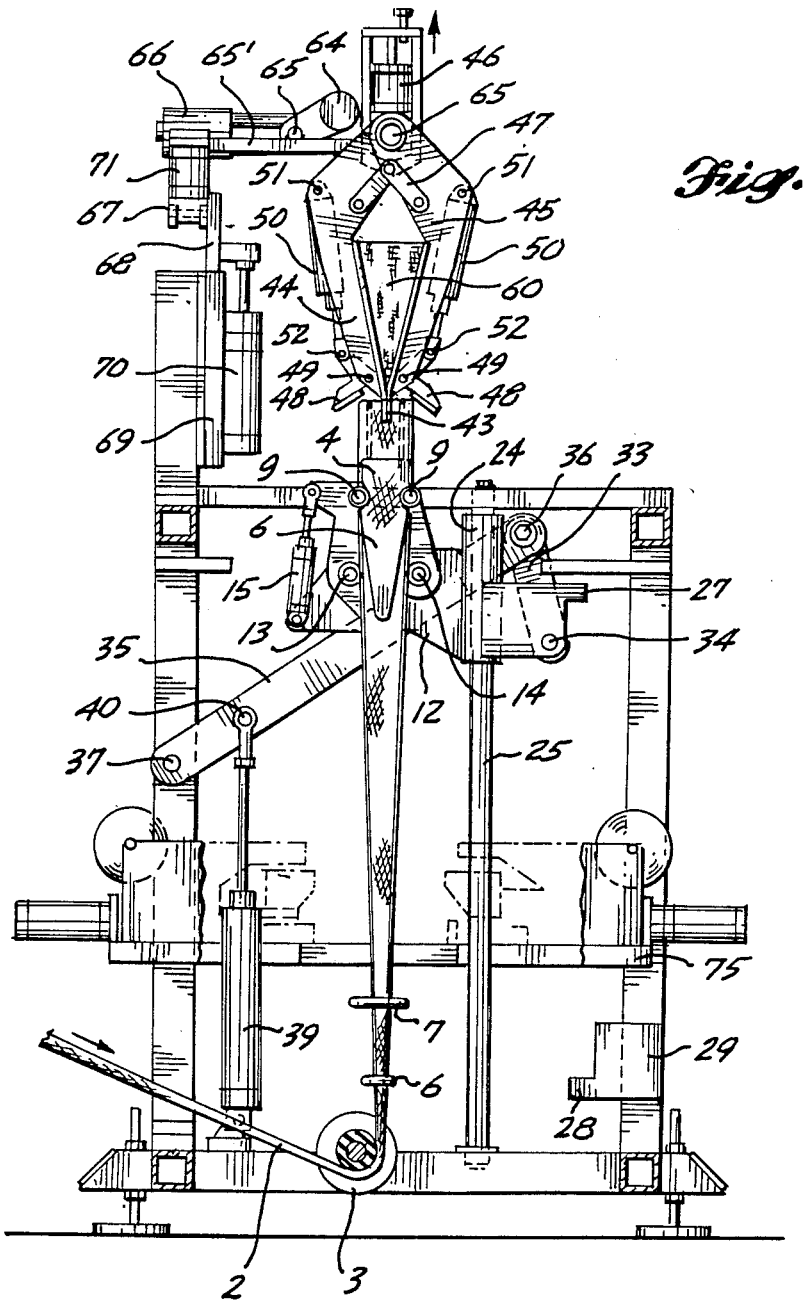
FIG. 4, FIG. 5, FIG. 6 and FIG. 7 are somewhat diagrammatic side elevations of the bag-making apparatus corresponding to FIG. 3, showing parts in different operating positions.

With the rods 9 pressed into their grooves 8, the upper end of bag-making material in which the distender 4, 5 is lodged will be gripped so that such gripping mechanism will operate as incremental feeder means for the bag-making material if the gripping means is moved upward from the position shown in FIG. 3 to the position shown in FIG. 4 to draw bag-making material from a supply. During such upward movement, the gripping means supporting plate 12 is guided by a sleeve 24 integral with it and sliding on an upright guide rod 25. The position of the gripping means in their lower position is determined by a plate 26 mounted on the guide sleeve 24 and having a horizontally projecting lug 27. Such lug will engage a stationary stop lug 28 projecting from a stop plate 29 which is mounted on an upright leg 30 of the frame by two securing pins 31. Such securing pins extend through appropriate apertures 32 in leg 30 to establish the desired elevational position of the stop lug 28. The position of stop plate 29 will determine the lowermost position of the gripper means mounting plate 12, because of the engagement of lug 27 on plate 26 with lug 28 as shown in FIG. 14, and consequently the length of the bag being made.

Figure 14:
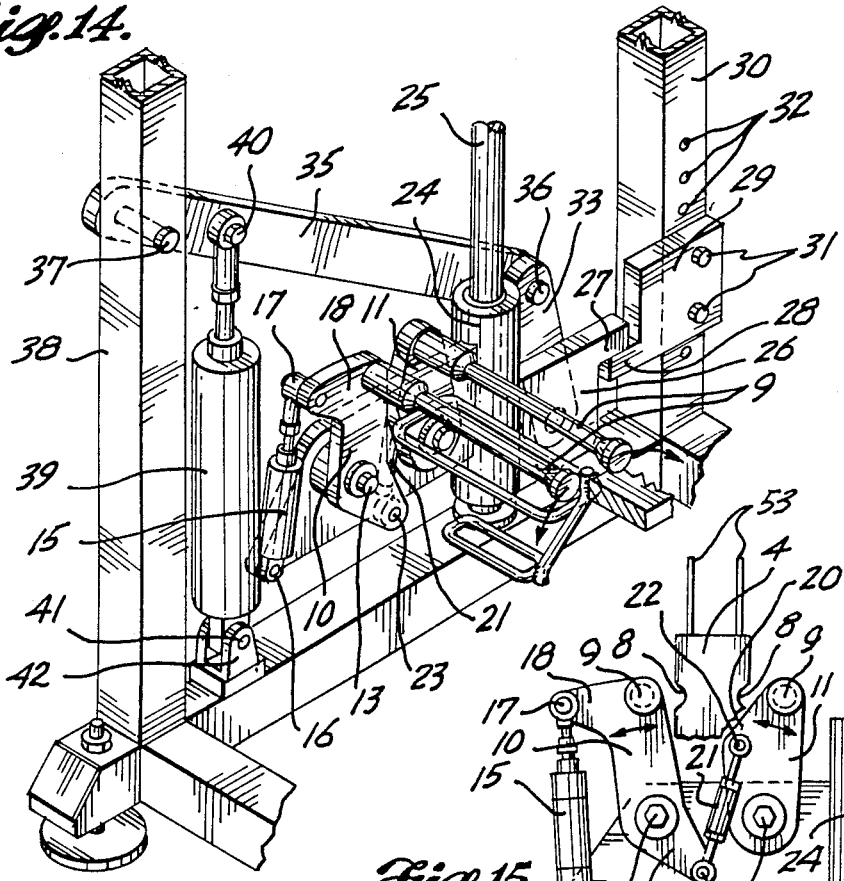
FIG. 14 is a fragmentary top perspective of a part of the lower,,portion of the apparatus.

Lifting of the gripping means including gripping rods 9 and the distender 4, 5 is effected by an upright link 33 having its lower end connected by pivot 34 to plate 26 and its upper end connected to the swinging end of a lever 35 by pivot 36 as shown in FIGS. 1 and 14. The fulcrum of such lever is formed by a pivot pin 37 extending through another leg 38 of the frame 1. The lever is swung by an actuator such as fluid pressure jack 39, preferably pneumatic, which is connected to the lever 35 by a pivot 40 located much closer to the lever fulcrum pivot 37 than the link pivot 36 is to such lever pivot. Such jack is supported by pivot 41 on a clevis bracket 42 mounted on the lower portion of the frame. The jack 39 will swing the lever 35 between the lowered position shown in FIGS. 1 and 14 and the raised position shown in FIG. 4. Such swinging movement of the lever will raise the gripping means to draw upward from the supply of bag-making material a length of such material appropriate to make a bag.

Figure 5:
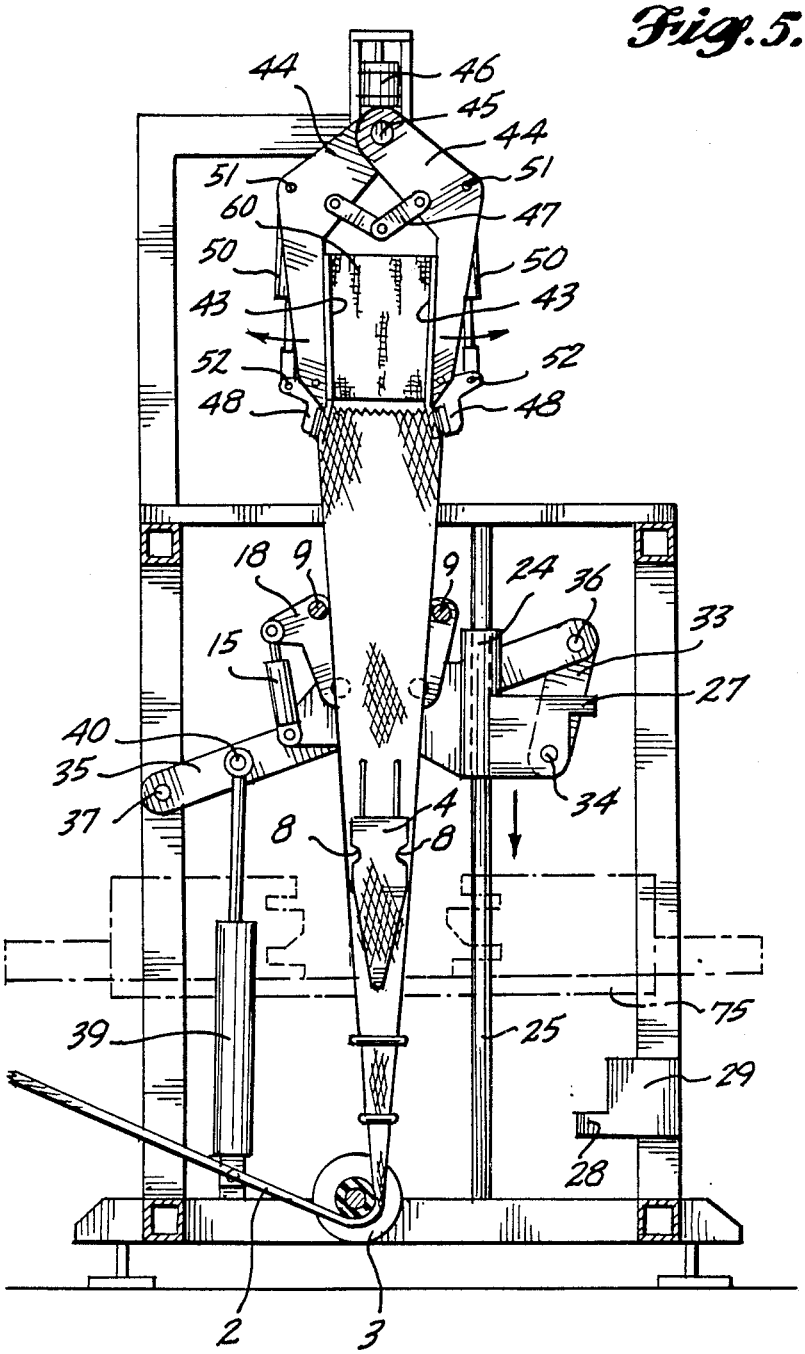
Figure 11:
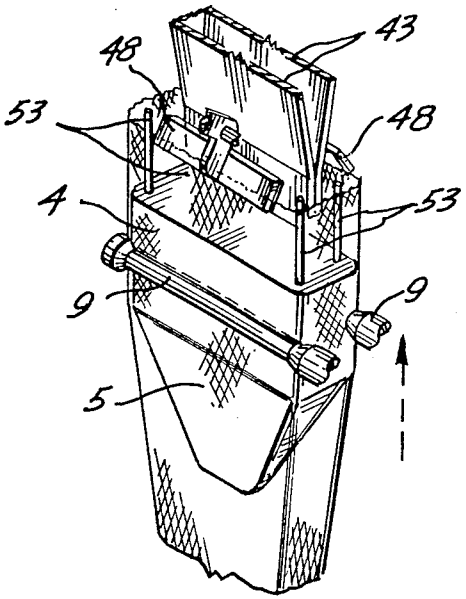
FIGS. 10, 11, 12 and 13 are fragmentary top perspectives of a portion of the apparatus shown in different operating positions.
Figure 12:
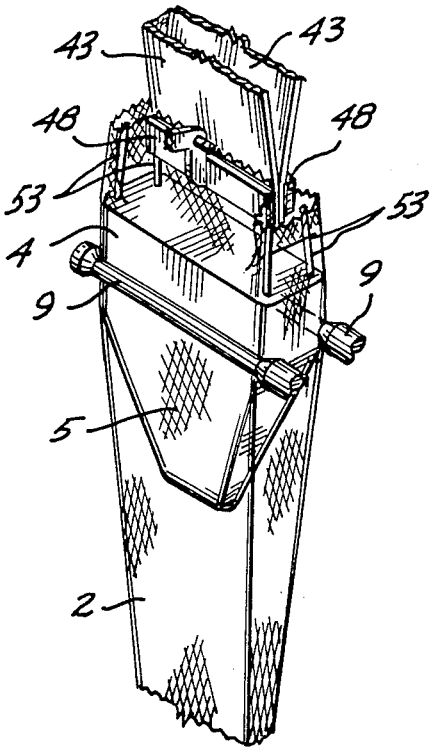

When the incremental feeder means formed by the gripping means and its lifting means described above has drawn upward a bag-making length of bag-making material, the upper portion of such length is transferred to clamping means 48 shown in open position in FIGS. 3 and 11 and in closed position in FIGS. 5 and 12. Such clamping means includes generally parallel horizontal lips forming the lower edges of side plates 43 that can be moved into close proximity with each other, as shown in FIGS. 4 and 11, from the spread position shown in FIG. 3 for insertion into the upper end of a bag-making length of bag-making material drawn upward from the bag material supplied by the incremental feeder gripping means described above as illustrated in FIG. 4. Such lips are carried on the lower ends of swingable clamp jaws 44 pivotally connected by a pivot 45 which also mounts such jaws on the frame 1. The jaws can be opened and closed by a jack 46 shown in FIG. 6 as being connected to a toggle joint 47 that interconnects portions of the jaws adjacent to the pivot 45. When the jack 46 is contracted, the links of the toggle joint will be pushed into general alignment by a yoke connecting the piston of such jack and the central pivot of the toggle joint, as shown in FIGS. 3 and 6, to spread the jaws, whereas when the jack 46 is extended the links of the toggle joint 47 are swung to the position shown in FIG. 4 to swing the clamp jaws together.

Figure 13:
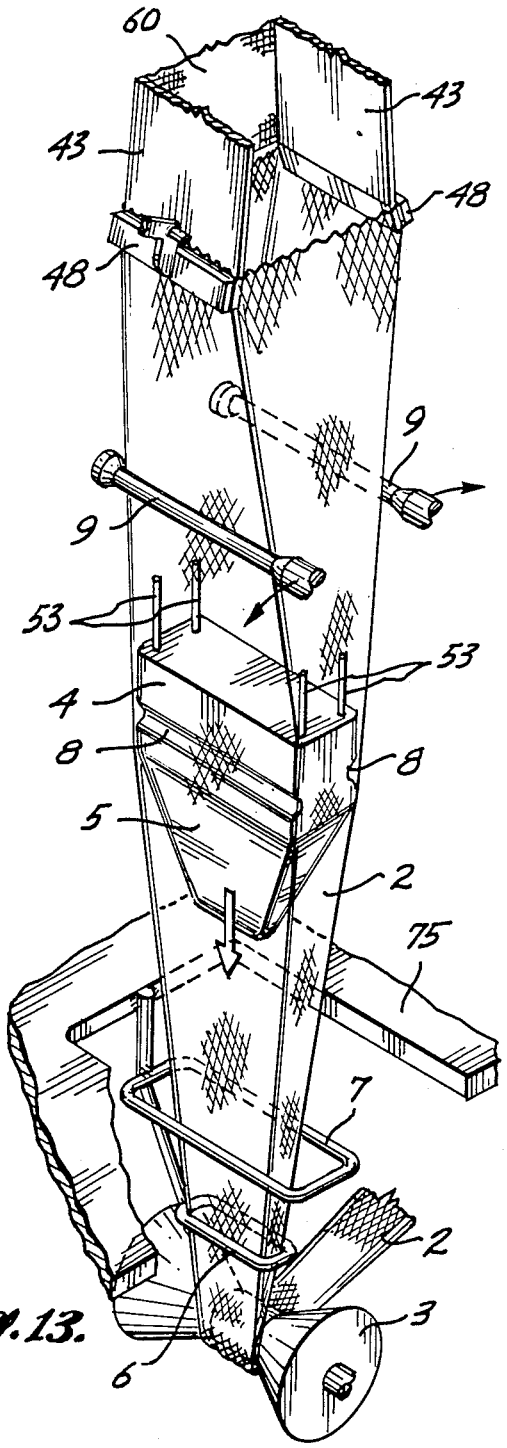

The clamping means is completed by clamp bars 48 mounted on the lower ends of the jaws by pivots 49 to swing between the unclamped positions shown in FIGS. 3, 4 and 11 and the clamping positions shown in FIGS. 5 and 12. The clamp bars are swung between their released positions and their clamping positions by jack 50 mounted on the respective clamp jaws 44 by pivots 51 and the lower ends of which are connected by pivots 52 to bell crank arms carried by the clamp bars 48. The upper end of the bag-making length of tubular bag-making material is held open to receive the lips 43 of the clamping mechanism by resilient cantilever wires 53 projecting upward from the corner portions of the distender upper section 4. The top of such distender section is preferably of approximately rectangular shape as shown in FIG. 13 and the wires are spaced apart lengthwise of such rectangular distender top a distance sufficient to receive the lips 43 and the clamp bars 48 of the clamping mechanism between them as shown in FIG. 12.

When the clamping means has clamped the opposite sides of the upper end portion of the bag-making length of bag-making material, as shown in FIG. 12, the jack 15 can be contracted to swing the arms 10 and 11 for moving the gripping rods 9 away from each other and out of their grooves 8 in the distender section 4 as shown in FIG. 15. The distender is thus released to fall freely through the bag-making length of the bag-making material from the position shown in FIG. 4 through the position shown in FIG. 5 to the position shown in FIG. 6. The distender will be stopped in this lower position by engagement with the stop rings 6 and 7.

Figure 6:
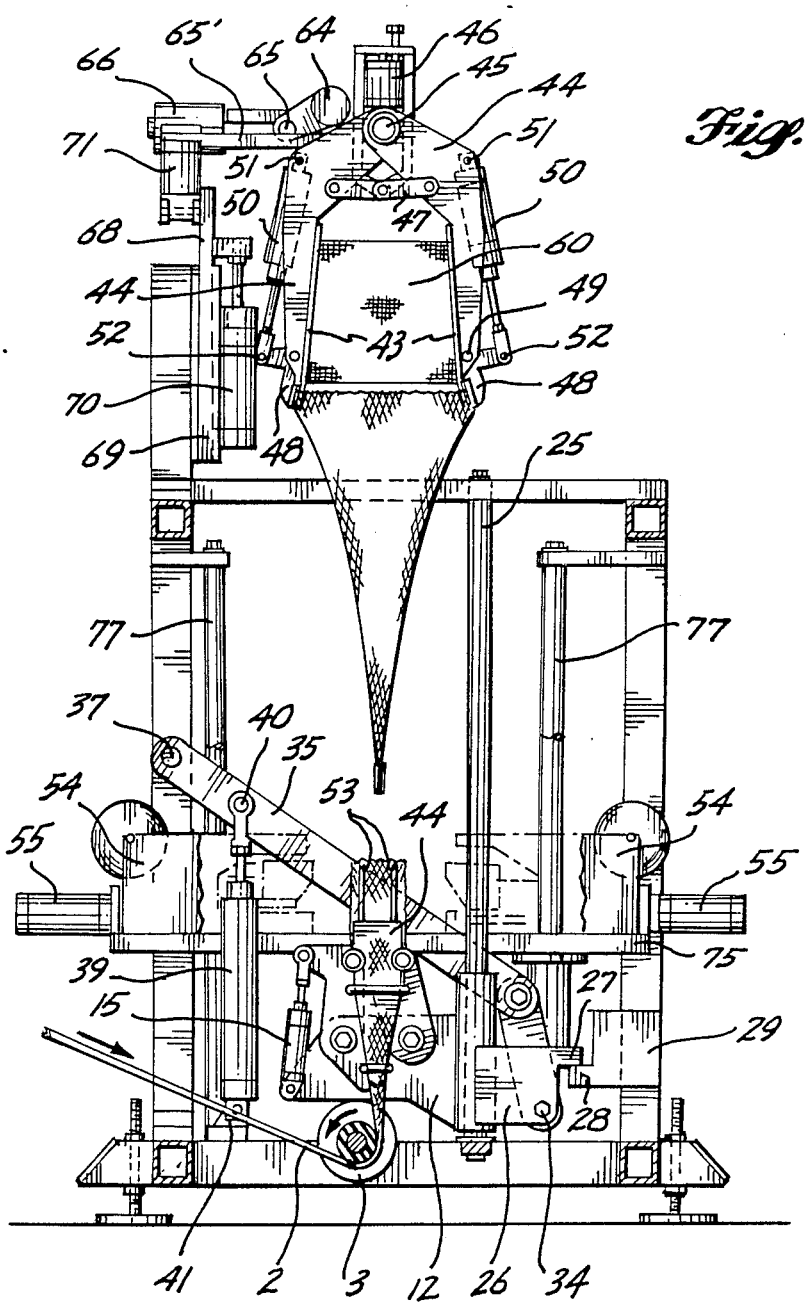

After the gripping means has been released, the jack 46 can be contracted to swing the clamp arms 44 from the position shown in FIG. 4 through the position shown in FIG. 5 to the position shown in FIG. 6 to spread the upper end portion of the bag-making length of material for receiving product. Simultaneously, after the gripping rods have been retracted from their grooves 8, the jack 39 can be contracted from the position shown in FIG. 4 through the position shown in FIG. 5 to the position of FIG. 6 for lowering the operating mechanism of the gripping rods including their supporting plate 12, guide sleeve 24 and stop plate 26. Downward movement of such mechanism will be stopped by engagement of lug 27 with lug 28, as discussed above and shown in FIG. 14.

Figure 16:
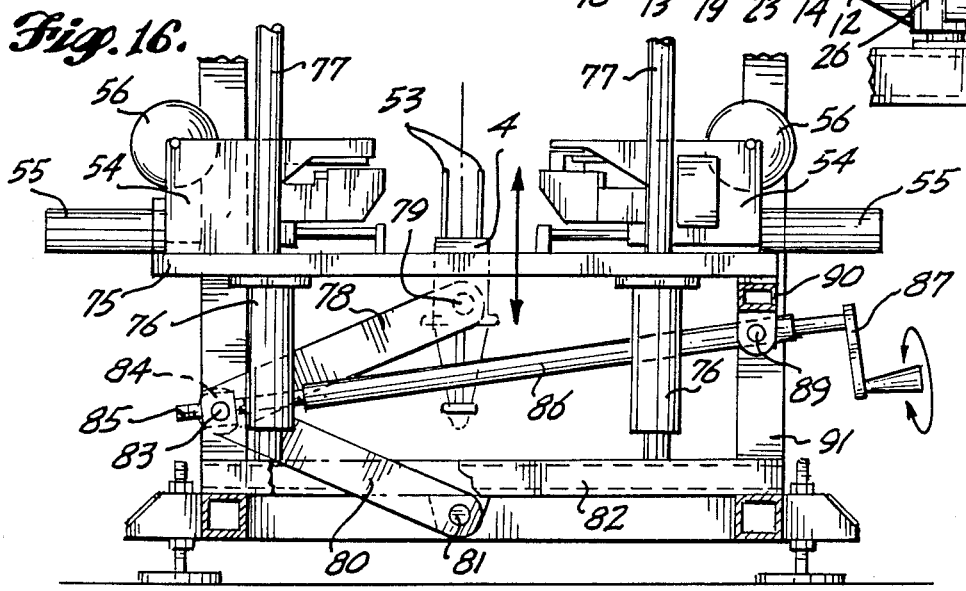
FIG. 16 is a side elevation of the lower portion of the apparatus with some parts omitted.

In order to close the bottom of the bag-making length of material drawn upward from the supply of bag-making material, as discussed above, severing and closing means are provided above the distender in its lower position, as shown in FIGS. 6 and 16, to cut the bottom of the bag-making length of material and close it. Such cutting and closing means include cooperating slides 54 reciprocable between the retracted positions shown in FIG. 16 and in broken lines in FIGS. 3, 4 and 5 and the operating position of one of such slides shown in FIG. 10. The slides are moved toward and away from each other by actuators such as fluid pressure jacks 55, preferably of the pneumatic type, between their inner operating positions and their retracted positions.

Figure 10:
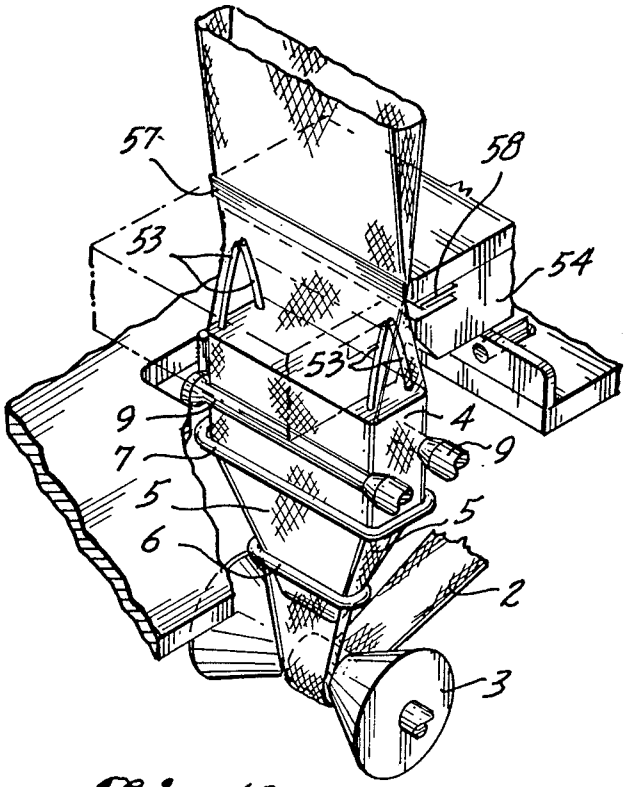

When the slides move toward each other into proximity with the bag-making material, the slides engage wires 53 to bend them toward each other, as shown in FIG. 10. Lengths of sealing tape are then fed from storage rolls 56 along opposite sides of the bag-making material and the slides are moved farther toward each other to clamp such sealing tapes which adhere to the bag-making material, and perhaps also to each other through apertures in the bag-making material if it is mesh, either because the tapes bear pressure-sensitive adhesive material or the slides are heated to set thermoplastic or thermosetting adhesive on the tapes. After the bag closure has been completed, the bag-making material will be severed just below the closure by a knife blade 58 shown in FIG. 10 which is reciprocable in one slide 54 to engage an anvil on the other slide 54. When the slides are retracted, they will be withdrawn from engagement with the spring fingers 53 which will straighten because of their inherent resiliency to spread the cut upper end portion of the next bag-making length of material to be drawn from the bag-making material supply, as shown in FIG. 6.

Figure 7:
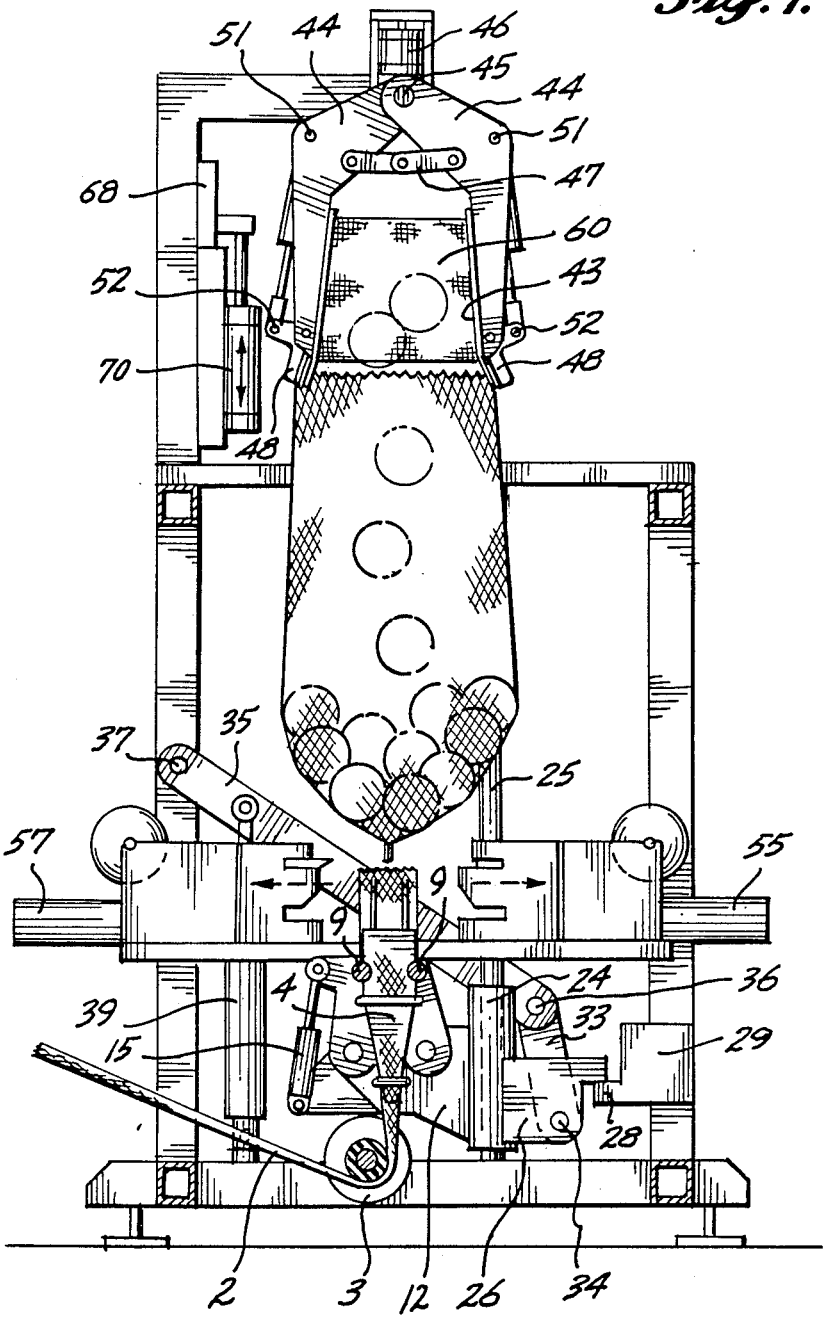

When the upper bag has been formed by closing the bottom and separating it from the supply of bag-making material and the upper end portion of the next bag to be formed has been spread apart, as shown in FIG. 6, product such as produce, for example, onions or oranges, can be delivered to the upper end of the bag to be deposited in the bag, as shown in FIG. 7. Such product will normally be delivered along a generally horizontal path such as by a conveyor 59 to a location above the upper end of the bag held open by the clamping means. Such product will be diverted from its generally horizontal path of travel downwardly into the bag by a barrier sheet 60 extending across the path of movement of the product between the side plates 43.

Figure 18:
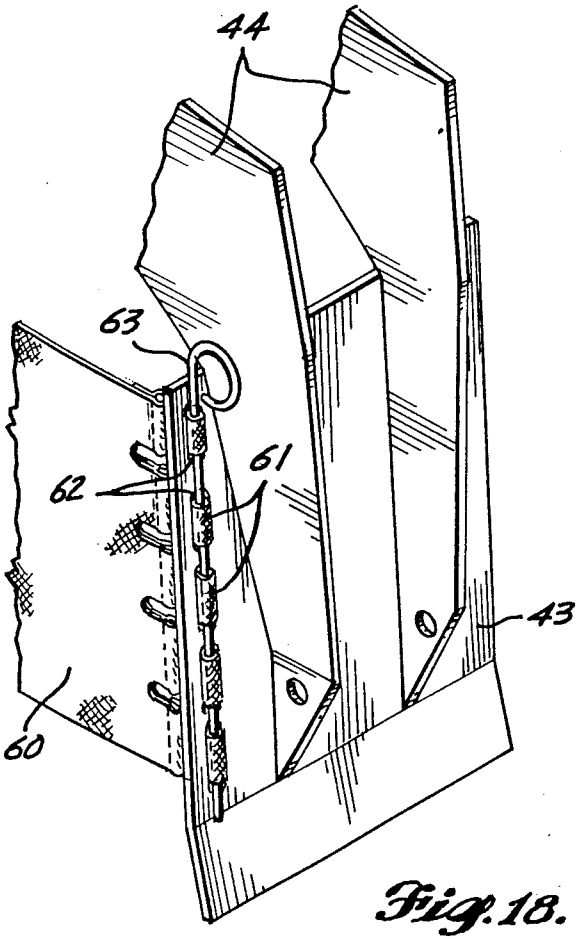
FIG. 18 is a similar view with parts assembled.
Figure 17:
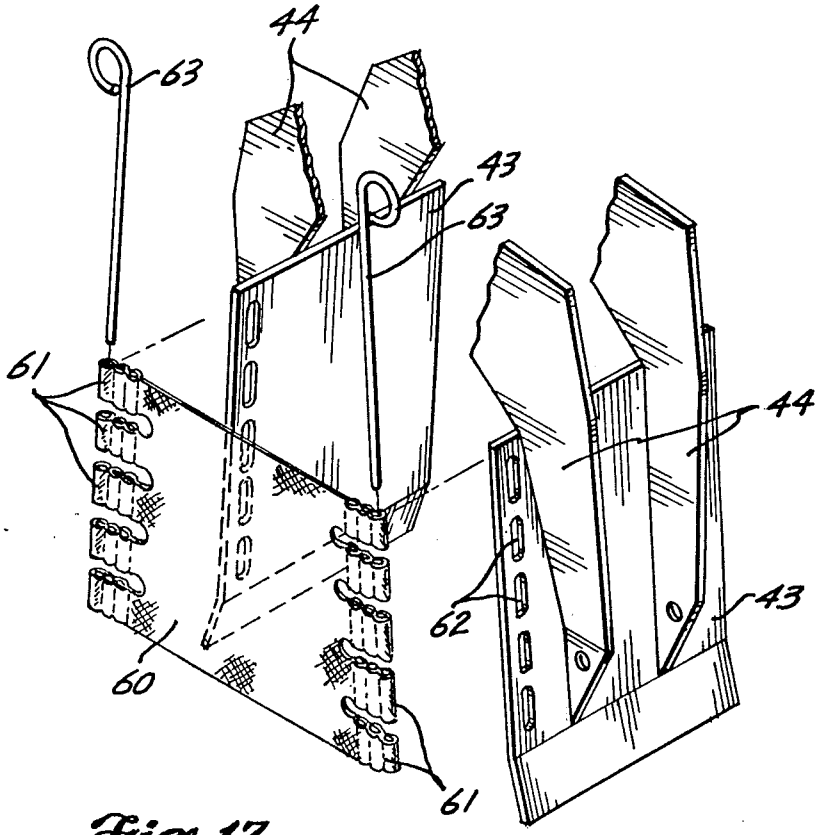
FIG. 17 is an enlarged detail top perspective of another portion of the apparatus with parts in exploded relationship.

Such barrier sheet has a series of tongues 61 carrying cylindrical sockets, which tongues can be inserted, respectively, through slots 62 in corresponding edges of side plates 43, as shown in FIG. 18. The tongues can be held in such slots by sliding retainer rods 63 through the sockets as shown in FIG. 18. Each edge of the barrier sheet can be adjusted relative to the adjacent side plate depending upon the length of the barrier sheet desired. The barrier sheet is flexible so that when the clamping jaws are moved toward each other, as shown in FIG. 4, the barrier sheet will collapse or fold. When the jaws are swung away from each other to the positions of FIGS. 6 and 7, the barrier sheet 60 will be stretched taut to limit the degree to which the jaws 44 are spread depending upon into which row of sockets in tongues 61 the retainer rods 63 have been inserted.

As shown in FIG. 1, the pivot rod 45 supporting the clamp jaws 44 is elongated and the clamp jaws and their actuating jack 46 can be displaced along such rod by an actuator such as a fluid pressure jack 64, preferably of the pneumatic type. A companion guide rod 65 parallel to pivot rod 45 and such pivot rod are connected by the crossbar 65'.

The rods 45 and 65 support the jack 64 between them and its piston rod is connected to a crossbar 65'' forming a rectangular support with the pivot rod 45, guide rod 65 and crossbar 65'. This support is mounted by pivot 66 on one end of a bar 67.

Figure 8:
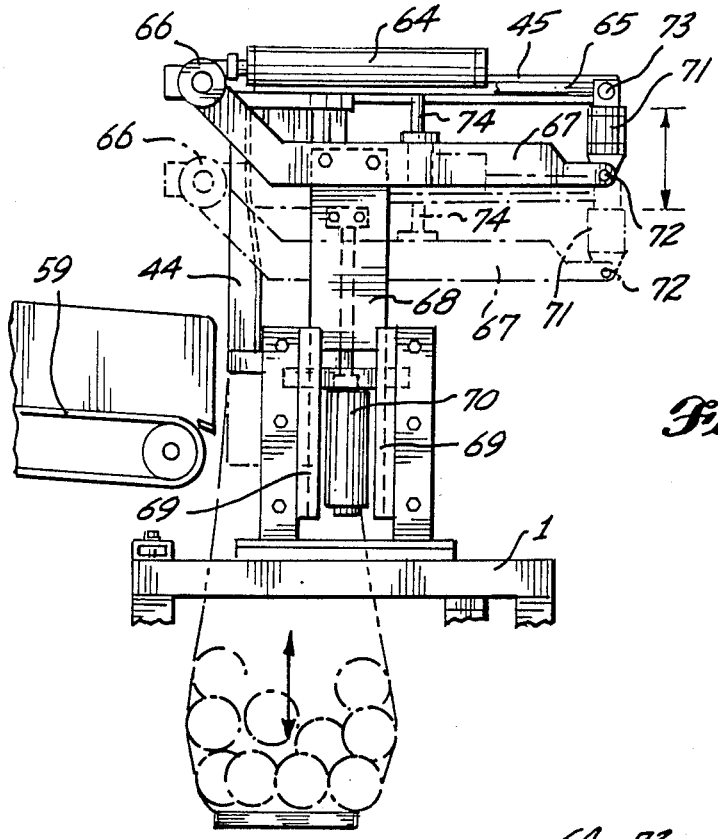
FIG. 8 and FIG. 9 are somewhat diagrammatic end elevations of the upper portion of the apparatus shown in different operating conditions.

During filling of the bag it is desirable to jog the clamp and its supporting mechanism to settle the produce in the bag. Such jogging operation is illustrated by FIG. 8 which shows the clamp-mounting bar 67 as being supported on the upper end of a slide plate 68 guided for elevational jogging in guideways 69. The jogging reciprocation of slide 68 relative to its guideways is effected by a pneumatic type of fluid pressure jack 70, mounted on the guideway structure and attached to the slide 68.

Figure 9:
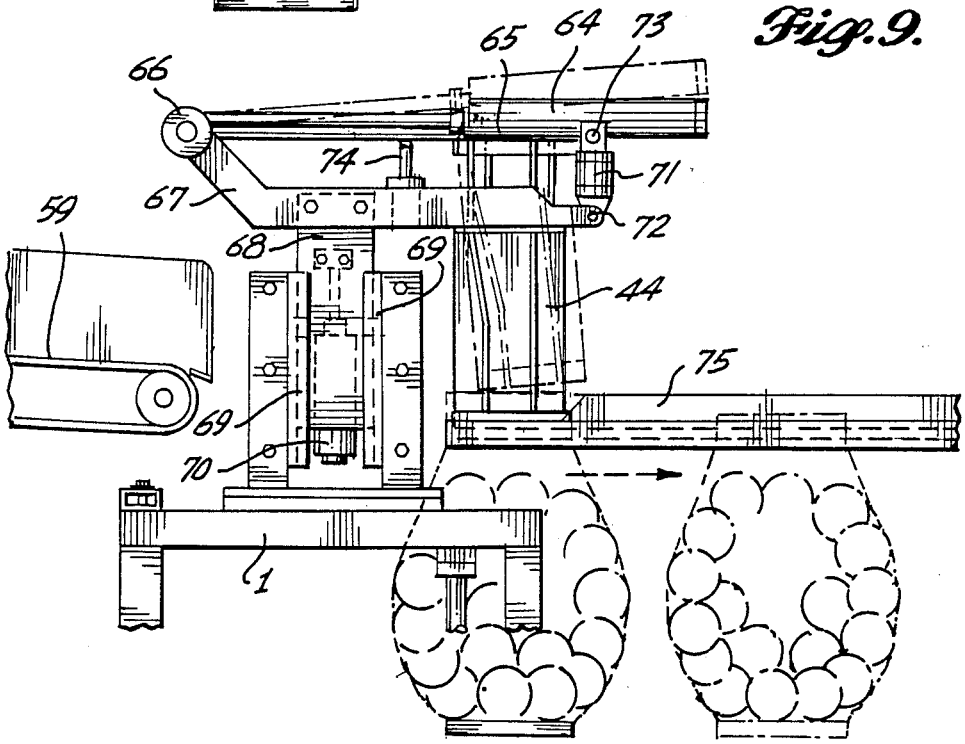

After the filled bag has been jogged to shake down the product within it, such bag supported by the clamps 48 is transported from the position shown in FIG. 8 to the position in full lines in FIG. 9 where the clamp bars 48 are swung open from their positions shown in FIGS. 6, 7 and 12 to their open positions shown in FIGS. 3 and 11. The clamp mechanism is then lifted out of the filled bag by an actuator such as a fluid pressure jack 71, preferably of the pneumatic type, having one end connected by pivot 72 to the bar 67 which supports the clamping mechanism and its other end connected by a ball joint 73 to the crossbar 65'. Extension of such jack will swing the support 45, 65 about pivot 66 from the solid line position to the broken line position shown in FIG. 9. The bag will then be supported by conveyor 75 for removal to a device for sealing its upper end.

When the bag has been removed, the clamp mechanism can be lowered again by contracting jack 71 which will lower the support frame to the position shown in FIG. 8 and in solid lines in FIG. 9.

It is desirable to enable the apparatus described above to make bags of different lengths. This ability is provided by supporting the stop rings 6 and 7 for distender 4, 5 and the severing and closing mechanisms slides 54 on an elevationally adjustable platform 75 shown in FIGS. 1 and 16. Such platform is guided for elevational movement by guide sleeves 76 projecting downward from it and sliding on upright guide rods 77. The upper ends of such guide rods are braced from the frame by brackets 77'.

The platform 75 is supported from the frame 1 by a toggle joint including an upper link 78 connected by a pivot 79 to the platform and a lower link 80 connected by a pivot 81 to the frame 1 of the apparatus. Such links are connected together by a pivot 83 carrying a nut 84 screwed onto the threaded end 85 of an adjusting rod 86. Such rod can be turned by a crank 87 shown in FIGS. 1 and 16. The crank end of the rod is mounted in a bearing 88 supported by a pivot 89 which is carried by a stub support bar 90 attached to a leg 91 of the frame.

In order to increase the elevational position of the platform 75, it is merely necessary to turn the crank 87 in a clockwise direction to draw the nut 84 toward the crank which will expand the toggle joint 78, 80 for shortening the length of the bags to be formed. Alternatively, if it is desired to lengthen the bags to be formed, the crank 87 will be turned in the opposite, counterclockwise direction to move nut 84 away from the crank and contract the toggle joint. The elevation of platform 75 will be reduced correspondingly to increase the length of the bags to be formed.

In making bags, the distender or shuttle 4, 5 serves the quadruple purpose of, first, cooperating with presser rods 9 in the formation of gripping means by which a length of bag-making material can be drawn upward, second, holding the upper end of a bag-making length of bag material open sufficiently to enable the upper clamping means to be engaged with the upper end of the bag in substitution for the distender gripping means, third, distending the bag material for the next bag to be made sufficiently as it descends to its lowest position for holding the bag-making material spread at the location of the bottom of the bag to be made so as to enable application to the bag bottom location of closure tapes and enable the closed bottom of the bag to be severed from the top of the next bag, and, fourth, utilizing the resilient wires projecting upward from the shuttle to reopen the upper end of the next bag length of material sufficiently to receive the clamping means bars 48 as stated in the second function above.

I claim:

1. A process for making bags which comprises providing a supply of continuous tubular bag-making material, inserting a distender within the end portion of such bag-making material to a location spaced from the end of the gab-making material, pressing presser means against the bag-making material overlying the distender and thereby gripping the end portion of such bag-making material, raising the presser means and thereby drawing upward from such supply a length of bag-making material appropriate to make a bag to dispose the upper end of such material in a raised location, at such raised location clamping the portion of the bag projecting upward above the distender, withdrawing the presser means from pressing the bag-making material against the distender and thereby releasing the distender to drop downward from the presser means to a lower position and thereby distending the bag-making material below the presser means, and subsequently lowering the presser means to such lower position of the distender and again moving the presser means toward the distender for pressing a new stretch of bag-making material against it.

2. The process defined in claim 1, including closing the bag-making material at a location slightly above the lower position of the distender and cutting the material to form a bag, spreading open the top of the bag, and depositing product to be bagged into the spread upper end of the bag.

3. Bag-making apparats comprising supply means for supplying tubular bag-making material, incremental feeder means for drawing upward from said supply means a bag-making length of material including movable backing means within such tubular bag-making material below the upper end thereof, presser means externally of such tubular bag-making material movable to press the bag-making material against said backing means for gripping the bag-making material, elevating means for raising said presser means and said backing means gripped thereby to an upper bag-making material transfer location, and clamp means at such bag-making material transfer location for clamping the upper end of such drawn length of bag-making material projecting above said backing means in substitution for said feeder means.

4. The bag-making apparatus defined in claim 3, in which the backing means includes a distender within the tubular bag-making material completely disengageable from the presser means outside the bag-making material.

5. The bag-making apparatus defined in claim 4, in which the elevating means is connected to the presser means independently of the distender, and the distender is free to fall within the tubular bag-making material when it is disengaged from the presser means.

6. The bag-making apparatus defined in claim 4, and means for withdrawing the presser means from the distender for enabling the distender to drop freely from the presser means.

7. The bag-making apparatus defined in claim 6, and stop means located below the bag-making material transfer location engageable by the falling distender for terminating its falling movement in a lower position.

8. The bag-making apparatus defined in claim 7, and bag material severing and closing means above the stop means and above the distender in its lower position for cutting and closing the bottom of a bag-making length of material to form a bag.

9. Bag-making apparatus comprising supply means for supplying tubular bag-making material, incremental feeder means for drawing upward from said supply means a bag-making length of material, clamp means for clamping the upper end of such drawn length of bag-making material in substitution for said feeder means, and bag-material severing and closing means located below said clamp means a distance equal to the desired length of a bag for cutting and closing the bottom of such bag-making length of material to form a bag, said incremental feeder means including a distender within the tubular bag-making material having resilient wires projecting upward therefrom for holding the upper end of the bag-making material sufficiently spread to receive a portion of said clamp means therein but bendable under pressure of said bag material severing and closing means against them.

10. Bag-making apparatus comprising supply means for supplying tubular bag-making material, incremental feeder means for drawing upward from said supply means a bag-making length of material, and clamp means for clamping the upper end of such drawn length of bag-making material in substitution for said feeder means, said incremental feeder means including a distender within the tubular bag-making material having resilient wires projecting upward therefrom for holding the upper end of the bag-making material sufficiently spread to receive a portion of said clamp means therein.

11. Bag-making apparatus comprising supply means for supplying tubular bag-making material, incremental feeder means for drawing upward from said supply means a bag-making length of material, clamp means for clamping the upper end of such drawn length of bag-making material in substitution for said feeder means, bag material severing and closing means located below said clamp means a distance equal to the desired length of a bag for cutting and closing the bottom of such bag-making length of material to form a bag, generally horizontal supply means for supplying product into the upper end of the bag held by the clamp means, and barrier means at the location of the clamp means for deflecting downward into the bag product supplied by the supply means.

12. A process for making a bag from a continuous length of tubular bag-making material which comprises inserting distending means within the tubular bag-making material, pressing external presser means against the bag-making material overlying the distending means, raising the presser means to move the distending means upward and thereby drawing upward a length of such material appropriate to make a bag, holding the upper end of such bag-making material length independently of the distending means and presser means, and withdrawing the presser means from the distending means for enabling the distending means to fall relative to the presser means for distending the tubular bag-making material below the holding means.

13. A process for making and filling a bag which comprises providing a supply of continuous tubular bag-making material, gripping the end portion of such bag-making material by gripping means and drawing upward from such supply a length of such material appropriate to make a bag, transferring the upper end portion of such bag-making material from such gripping means to clamp means, closing the lower end of such bag-making length of material below the clamp means to form a bag, severing from the continuous bag-making material the bag length of bag-making material, spreading the clamp means to open the upper end portion of the bag, and depositing product to be bagged into the spread upper end of the bag.

14. The process defined in claim 13, in which the gripping of the end portion of the bag-making material is effected by inserting a backing means within the tubular bag-making material and pressing a presser member against the bag-making material overlying such backing means for gripping the bag-making material.

* * * * *